US011352844B2

(12) United States Patent
von Gynz-Rekowski et al.

(10) Patent No.: US 11,352,844 B2
(45) Date of Patent: Jun. 7, 2022

(54) FLOW RATE CONTROL SYSTEM AND METHOD

(71) Applicant: Workover Solutions, Inc., Imperial, PA (US)

(72) Inventors: Gunther H H von Gynz-Rekowski, Montgomery, TX (US); Russell Wayne Koenig, Conroe, TX (US); Kevin James Rudy, Tomball, TX (US)

(73) Assignee: Workover Solutions, Inc., Imperial, PA (US)

( * ) Notice: Subject to any disclaimer, the term of this patent is extended or adjusted under 35 U.S.C. 154(b) by 117 days.

(21) Appl. No.: 16/918,383

(22) Filed: Jul. 1, 2020

(65) Prior Publication Data

US 2022/0003045 A1 Jan. 6, 2022

(51) Int. Cl.

| | |
|---|---|
| ***E21B 21/10*** | (2006.01) |
| ***E21B 21/08*** | (2006.01) |
| ***E21B 34/08*** | (2006.01) |
| ***E21B 34/14*** | (2006.01) |
| ***E21B 44/00*** | (2006.01) |
| ***E21B 10/32*** | (2006.01) |

(52) U.S. Cl.

CPC ..... *E21B 21/103* (2013.01); *E21B 10/322* (2013.01); *E21B 21/08* (2013.01); *E21B 34/08* (2013.01); *E21B 34/14* (2013.01); *E21B 44/005* (2013.01)

(58) Field of Classification Search

CPC ..... E21B 10/322; E21B 21/08; E21B 21/103; E21B 34/08; E21B 34/14; E21B 44/005

See application file for complete search history.

(56) References Cited

U.S. PATENT DOCUMENTS

| | | | | |
|---|---|---|---|---|
| 6,173,795 | B1 * | 1/2001 | McGarian | E21B 23/006 175/231 |
| 6,263,969 | B1 | 7/2001 | Stoesz et al. | |
| 7,766,084 | B2 | 8/2010 | Churchill | |

(Continued)

OTHER PUBLICATIONS

PCT International Searching Authorityius, International Search Report and Written Opinion dated Aug. 17, 2021, from Applicant's counterpart International Patent Application No. PCT US2021/32273.

(Continued)

*Primary Examiner* — Michael R Wills, III

(74) *Attorney, Agent, or Firm* — Jones Walker LLP

(57) ABSTRACT

A flow rate control system includes a housing and a valve assembly slidingly disposed within a housing inner bore. The housing includes bypass openings. The valve assembly includes a valve and an orifice disposed in a valve inner bore. The valve includes a plurality of valve bypass bores extending axially through a valve collar. The valve assembly slides between closed and fully open positions. A spring biases the valve assembly toward the closed position in which the valve closes the housing bypass openings. In the open position, a bypass fluid path is formed including the valve bypass bores and the housing bypass openings. The valve assembly is flow rate controlled in the closed position and pressure controlled in the open position. The valve assembly may slide within a sleeve assembly including sleeve bypass openings, which connect the valve bypass bores and housing bypass openings in the bypass fluid path.

22 Claims, 14 Drawing Sheets

(56) References Cited

U.S. PATENT DOCUMENTS

| | | | | |
|---|---|---|---|---|
| 9,045,966 | B2 * | 6/2015 | Ali | E21B 23/006 |
| 9,145,748 | B1 | 9/2015 | Meier et al. | |
| 9,328,576 | B2 * | 5/2016 | Cramer | E21B 34/14 |
| 2009/0056952 | A1 | 3/2009 | Churchill | |
| 2014/0020955 | A1 | 1/2014 | Cramer et al. | |
| 2018/0038180 | A1 * | 2/2018 | Cramer | E21B 21/103 |
| 2018/0230750 | A1 | 8/2018 | Lorenson et al. | |
| 2018/0306000 | A1 | 10/2018 | Deboer | |
| 2019/0136653 | A1 | 5/2019 | Hern et al. | |

OTHER PUBLICATIONS

DTI Downhole Tools International, DTI Active Pressure Relief Valve, 2019.
General Downhole, Regulator sub, Nov. 2013.
KRC Resources, Inc., PBL Multiple Activation Autolock Bypass System.

* cited by examiner

FLOW RATE CONTROL SYSTEM AND METHOD

BACKGROUND

In the process of drilling oil and gas wells, downhole drilling motors may be connected to a drill string to rotate and steer a drill bit. Conventional drilling motors typically provide rotation with a power section, which may be a positive displacement motor driven by circulation of drilling fluid or drilling mud.

As wellbores are drilled faster, higher flow rates of drilling fluid are required to clear drill cuttings from the wellbore. Each drilling motor is designed to operate with a maximum flow rate of the drilling fluid. For example, a conventional drilling motor having an outer diameter of 6.75 inches may be designed for a maximum flow rate of about 600 gallons per minute (GPM). Exceeding the maximum flow rate for a drilling motor may cause premature failure of the bearing section due to erosion.

Existing tools can divert a portion or all of the drilling fluid above the drilling motor in order to reduce the flow rate of the drilling fluid before it reaches the drilling motor. If a tool is used to bypass all drilling fluid to the annulus, the drilling fluid can be changed to a different media, such as a LCM drilling fluid or even a fracking fluid. Some bypass diverter tools include passive valves, which are activated by an independent mechanism. For example, a ball, dart, or RFID device inserted into the drilling fluid at the surface engages a receptacle when it reaches the diverter tool, and this interaction opens the valve to begin diverting drilling fluid into the well annulus above the drilling motor. However, these passive valve tools involve a delay of 10 minutes to 15 minutes from the time the action is taken (e.g., the ball or dart is dropped at the surface) to the time the valve is opened. This delay increases the cost of drilling a wellbore.

Other bypass diverter tools include active valves, which are activated automatically in response to a downhole parameter. For example, a change in flow rate, pressure, density, or rotational rate to a predetermined threshold value automatically opens a valve to divert a portion of the drilling fluid into the wellbore annulus above the drilling motor. However, these active valve tools are sometimes unintentionally activated by downhole parameter changes independent from surface activation, such as vibration, bit plugging, or motor stalling. There is a need for an active valve tool that diverts a portion of a fluid flowing through a drill string into a wellbore annulus that is not unintentionally activated.

BRIEF DESCRIPTION OF THE DRAWING VIEWS

DETAILED DESCRIPTION OF SELECTED EMBODIMENTS

Figure 1:
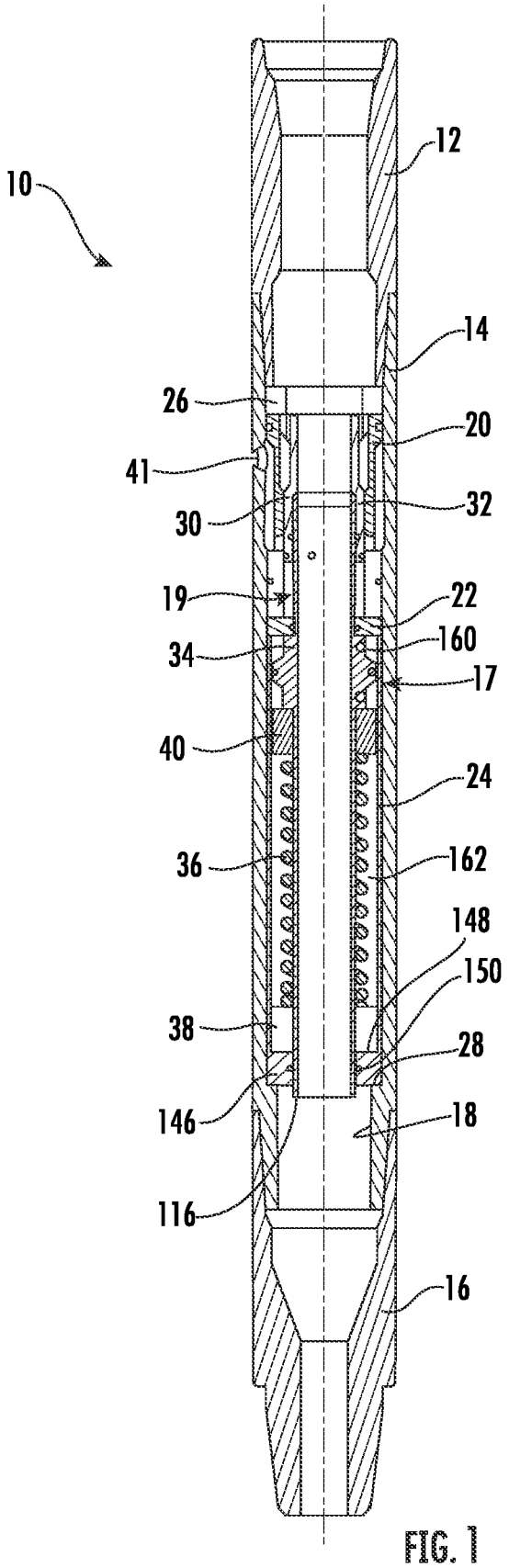
FIG. 1 is a sectional view of a flow rate control system in a closed position.

A flow rate control system includes a valve assembly slidingly disposed within a housing. The valve assembly slides between a closed position, a partially open position, and a fully open position. A spring applies a spring force to bias the valve assembly toward the closed position. The valve assembly is flow rate controlled in the closed position and pressure controlled in the fully open position.

In one embodiment, the flow rate control system also includes a sleeve assembly fixed within the housing. The valve assembly is slidingly disposed within the sleeve assembly to slide between the closed position, the partially open position, and the fully open position.

In the closed position, a fluid flowing through the system applies a force on a first active valve area. Increases in the fluid flow rate apply increased forces on the first active valve area. When the increased force exceeds a threshold value that overcomes the spring force, the valve assembly begins to slide toward the partially open position. When the valve assembly reaches the partially open position, a portion of the fluid may begin to flow through a bypass fluid path that leads to an annular space surrounding the housing. In this way, the flow rate control system ensures that the flow rate of fluid flowing to a drilling motor positioned below (i.e., downstream) does not exceed a maximum flow rate value that the drilling motor is designed to tolerate. Instead, the excess fluid flow is diverted through the bypass fluid path into the annular space surrounding the housing. The valve assembly has a second active valve area, which becomes active in the partially open position and remains active in the fully open position. The second active valve area is biased downward by the pressure differential between an inner bore of the valve assembly and the annular space around the housing. In the partially open and fully open positions, the pressure in the system applies a downward force on the second active valve area. When the bypass fluid flow begins in the partially open position, the force applied to the second active valve area continues to move the valve assembly toward the fully open position and prevents the valve assembly from closing.

In one embodiment, the valve assembly includes valve bypass bores providing fluid communication across a valve collar. In the closed position, the pressure above the valve collar is equal to the pressure below the valve collar. For this reason, the valve assembly is flow rate controlled in the closed position. However, in the partially open and fully open positions, the valve bypass bores are in fluid communication with the annular space surrounding the housing such that the pressure below the valve collar is less than the pressure above the valve collar. For this reason, the valve assembly is a pressure controlled valve in the partially open and fully open positions.

Accordingly, if the fluid pumping temporarily stops or slows (e.g., the pump stops, the drill bit becomes plugged, or the motor stalls), the valve assembly will not change position (i.e., the valve assembly will not return to the closed position) until the pressure differential between the inside of the flow rate control system and the annular space surrounding the housing is reduced. Increasing the pressure in the annular space, decreasing the pressure in the drill string, or allowing the pressure to equalize through the bypass fluid path allows the spring, which is exerting a force on the valve assembly in an upward direction toward the closed position, to begin to close the valve. When this upward force exceeds the force exerted on the second active valve area in the downward direction, the valve assembly moves into the closed position again.

In one embodiment, the flow rate control system includes dampening chambers disposed between the valve assembly and the sleeve assembly. Dampening nozzles through a radial surface of the valve assembly allow fluid communication between an inner bore of the valve assembly and the dampening chambers to slow the sliding movement of the valve assembly relative to the sleeve assembly.

In one embodiment, the flow rate control system may include a complete bypass position in which the inner bore of the valve assembly is completely closed below the bypass fluid path. In the complete bypass position, all of the drilling fluid flowing through the system is diverted to the annulus and the flow of drilling fluid to the motor below is stopped. With the flow rate control system in the complete bypass position, the drilling fluid can be replaced by other types of fluids, such as LCM fluid, perforating fluid, or fracking fluid.

Figure 2:
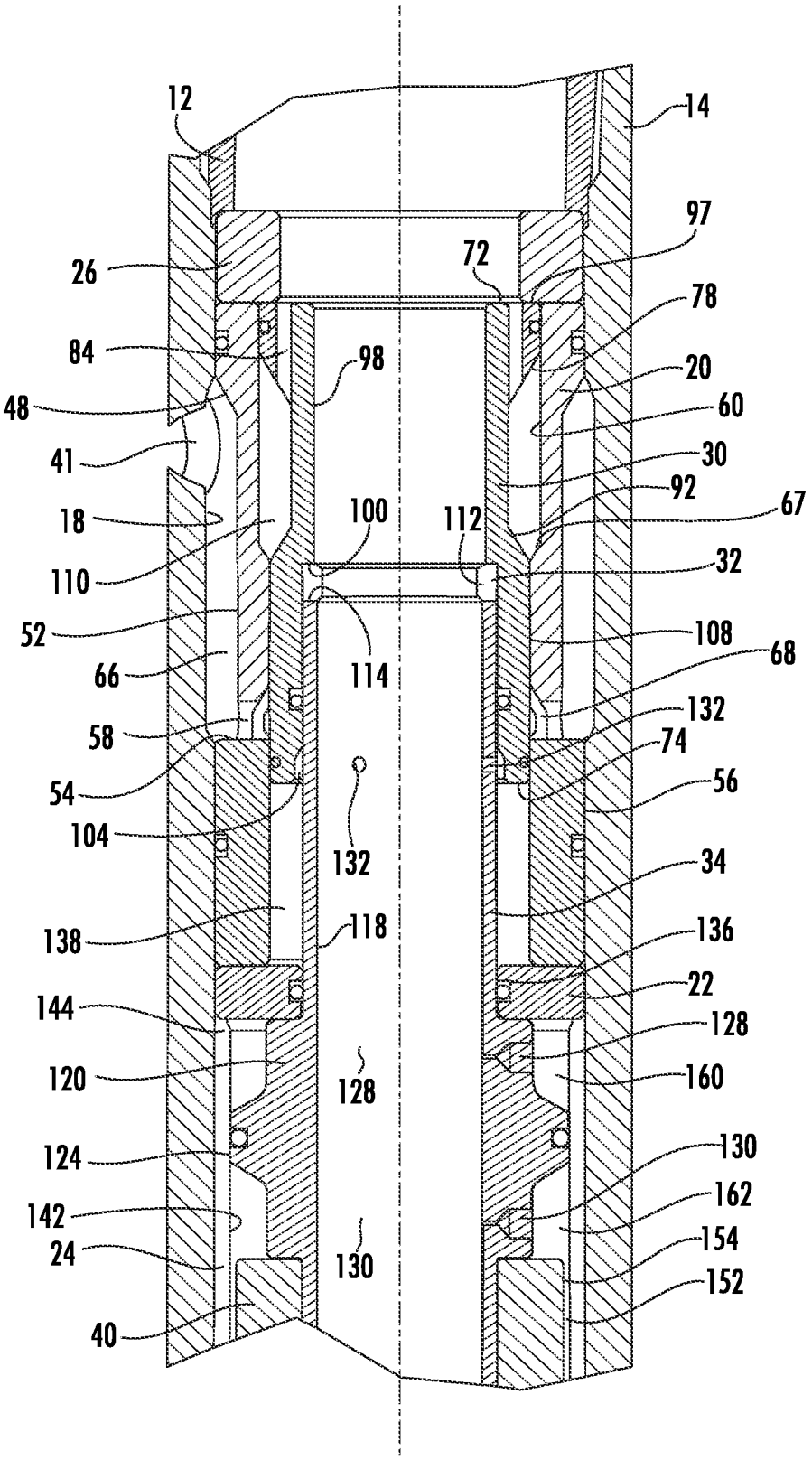
FIG. 2 is a detail sectional view of a portion of the flow rate control system in the closed position.

FIGS. 1 and 2 illustrate one embodiment of a flow rate control system in a closed position. Flow rate control system 10 includes upper sub 12, housing 14, and lower sub 16, each having a generally tubular shape with an inner bore. An upper end of upper sub 12 may be configured for connection to tubular members in a drill string. An upper end of housing 14 may be connected to a lower end of upper sub 12, and a lower end of housing 14 may be connected to an upper end of lower sub 16. A lower end of lower sub 16 may be configured for connection to tubular members in a drill string. In one embodiment, each of these connections is a threaded connection. The flow rate control system may be secured in a drill string above a bottom hole assembly that includes a drilling motor.

Flow rate control system 10 may include sleeve assembly 17 secured within housing inner bore 18 and valve assembly 19 slidingly disposed within sleeve assembly 17. Sleeve assembly 17 may include valve sleeve 20, valve stop 22, and spring sleeve 24. Upper ring 26 may be secured within housing inner bore 18 between an upper end of valve sleeve 20 and a lower end of upper sub 12. In this way, sleeve assembly 17 is secured within housing inner bore 18 between upper ring 26 and lower housing shoulder 28. Valve assembly 19 may include valve 30, orifice ring 32, and spring mandrel 34. Spring 36, lower spring ring 38, and upper spring ring 40 may each be disposed around spring mandrel 34 and within spring sleeve 24. A lower end of spring 36 may engage lower spring ring 38, and an upper end of spring 36 may engage upper spring ring 40. Housing 14 may include one or more housing bypass openings 41 extending radially from housing inner bore 18 to an outer surface of housing 14. Housing 14 may include any number of housing bypass openings 41. For example, housing 14 may include between 1 and 10 housing bypass openings 41. Valve sleeve 20 is aligned with the one or more housing bypass openings 41 within housing inner bore 18, and valve 30 is slidingly disposed within an inner bore of valve sleeve 20.

Figure 3:
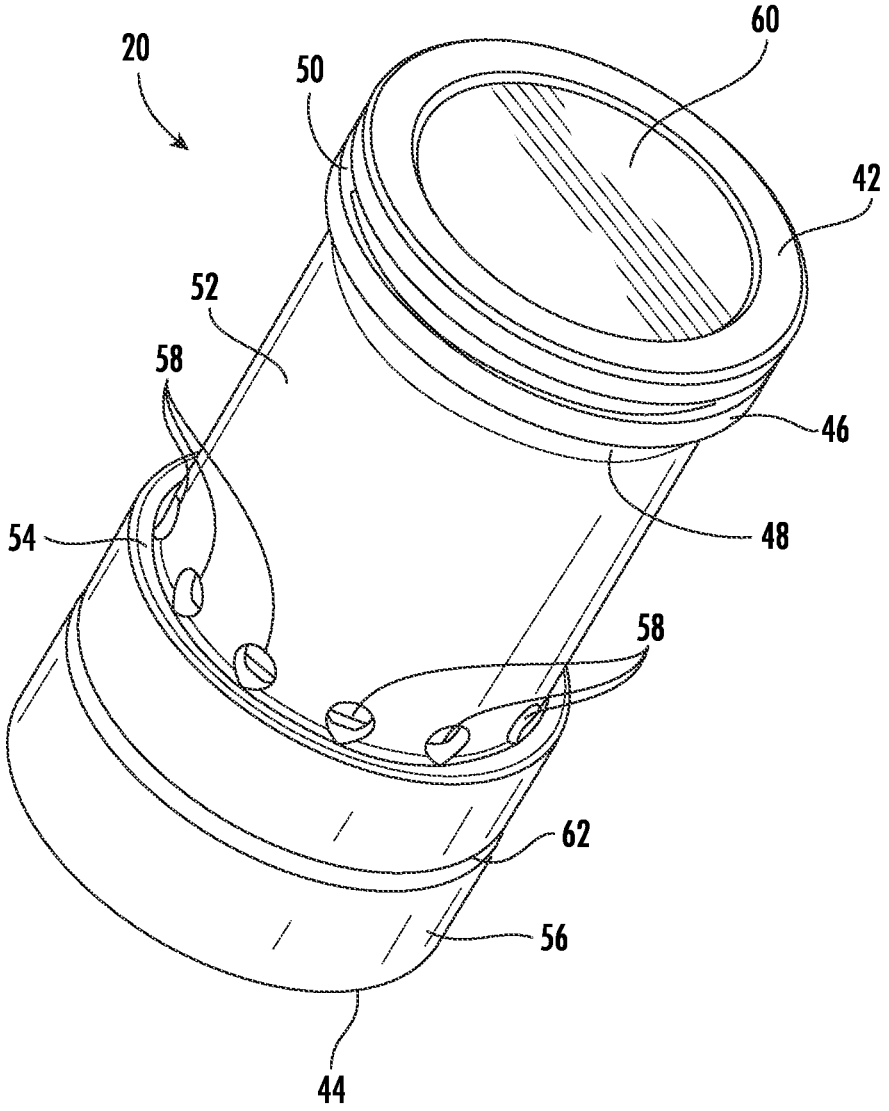
FIG. 3 is an isometric view of a valve sleeve of the flow rate control system.
Figure 4:
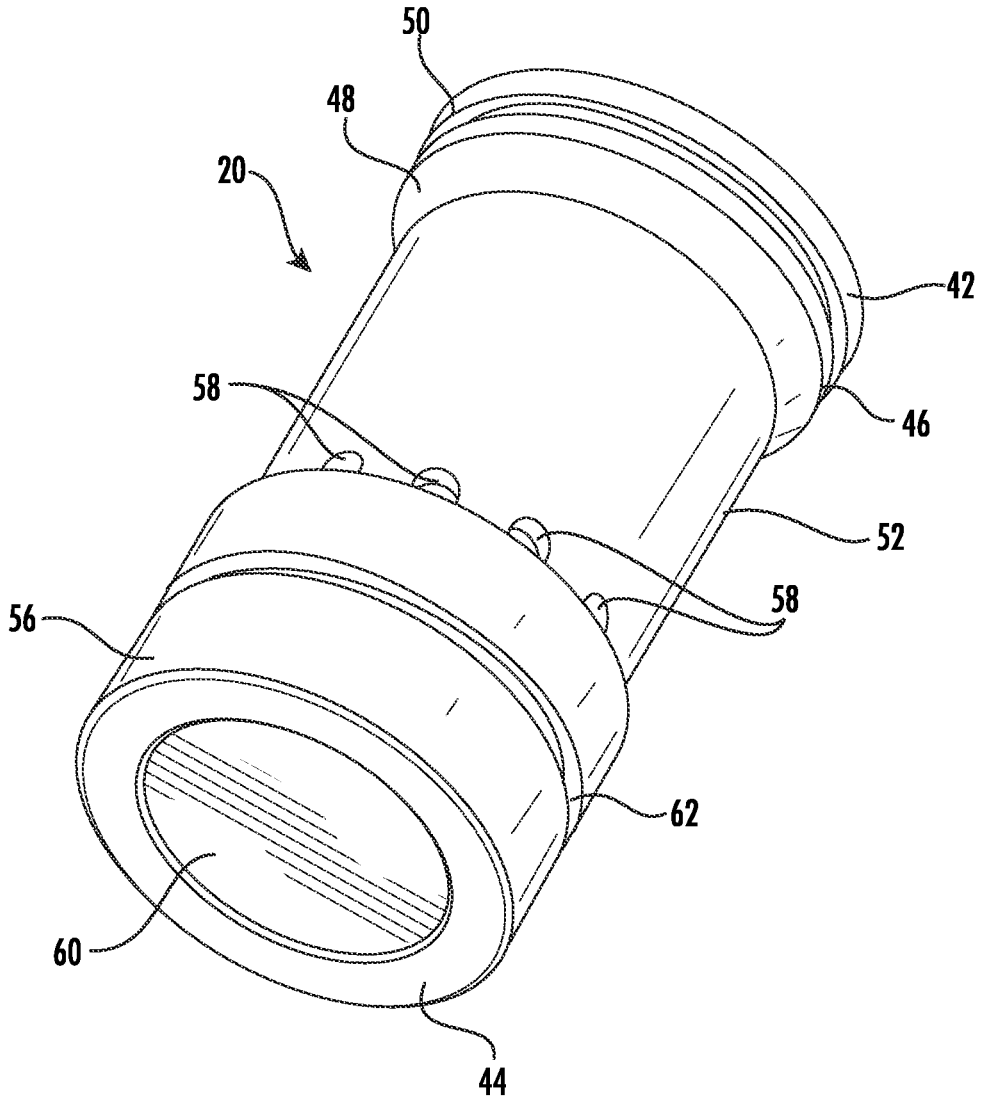
FIG. 4 is another isometric view of the valve sleeve.
Figure 5:
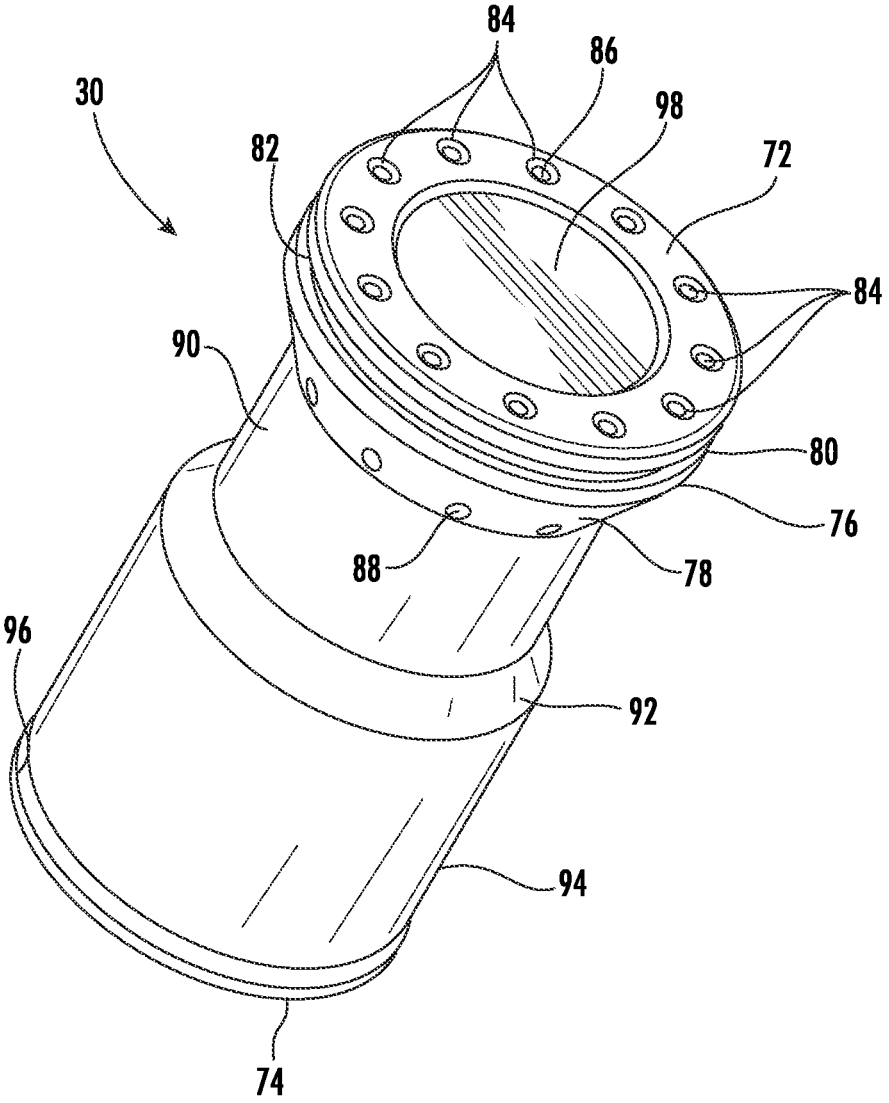
FIG. 5 is an isometric view of a valve of the flow rate control system.
Figure 6:
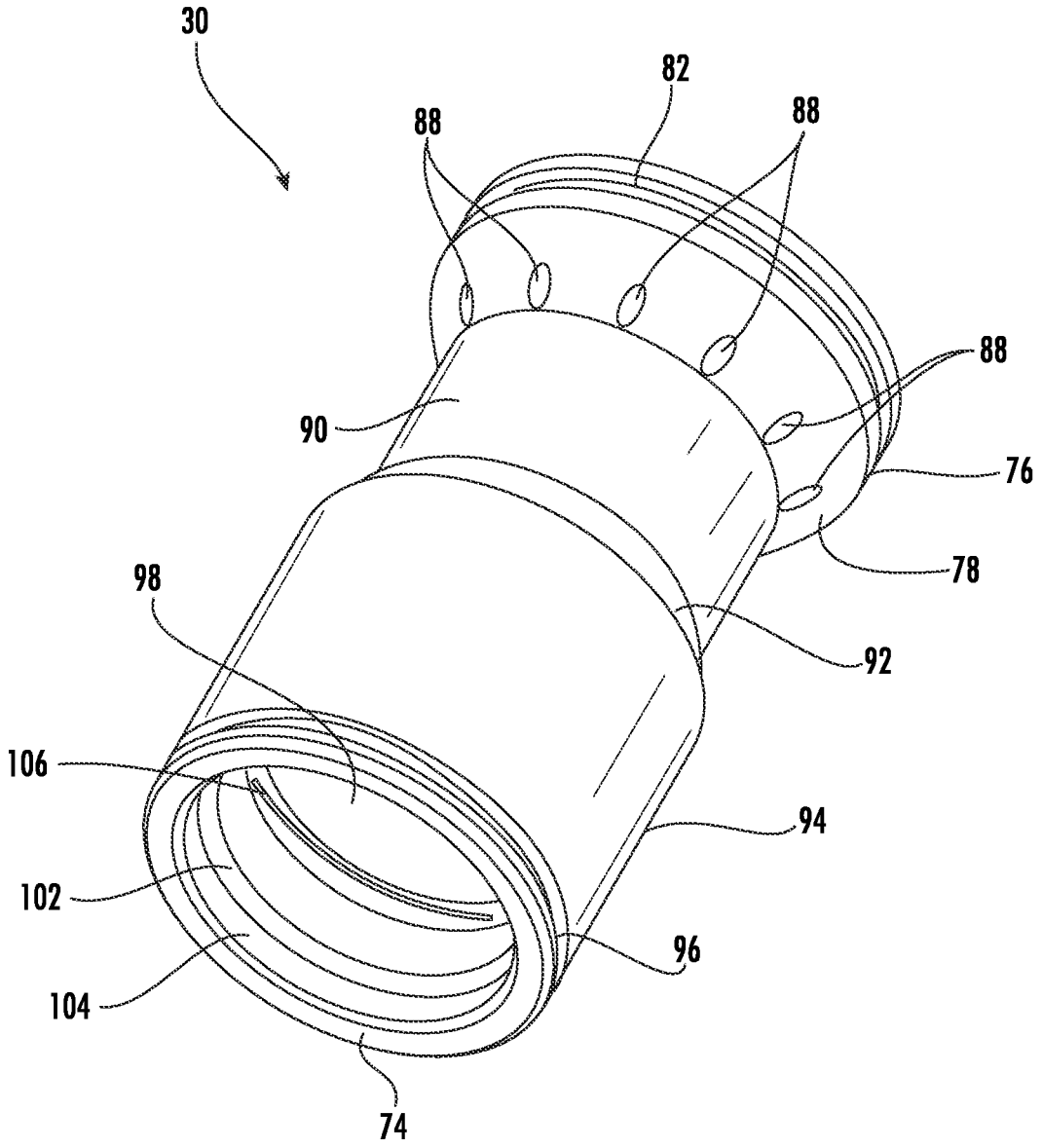
FIG. 6 is another isometric view of the valve.

With reference to FIGS. 3 and 4, valve sleeve 20 has a generally tubular shape and extends from upper end 42 to lower end 44. Upper outer surface 46 of valve sleeve 20 extends from upper end 42 to tapered shoulder 48. Upper outer surface 46 may include recess 50 configured to house an O-ring or other seal mechanism for providing a fluid seal between valve sleeve 20 and housing 14. Reduced diameter section 52 extends from tapered shoulder 48 to shoulder 54 of lower outer surface 56. Reduced diameter section 52 includes a plurality of valve sleeve bypass openings 58 proximate to shoulder 54. Each valve sleeve bypass openings 58 extends radially from inner bore 60 to the outer surface of valve sleeve 20. Valve sleeve 20 may include any number of valve sleeve bypass openings 58. For example, valve sleeve 20 may include between 1 and 50 valve sleeve bypass openings 58. Lower outer surface 56 extends from shoulder 54 to lower end 44. Lower outer surface 56 may include recess 62 configured to house an O-ring or other seal mechanism for providing a fluid seal between valve sleeve 20 and housing 14. Inner bore 60 extends from upper end 42 to lower end 44.

Referring now to FIG. 2, valve sleeve 20 may be disposed within housing inner bore 18 with reduced diameter section 52 of valve sleeve 20 aligned with the one or more housing bypass openings 41. Outer bypass chamber 66 between valve sleeve 20 and housing 14 may be defined by housing inner bore 18 and reduced diameter section 52. The upper end of outer bypass chamber 66 may be defined by tapered shoulder 48 of valve sleeve 20, and the lower end of outer bypass chamber 66 may be defined by shoulder 54 of valve sleeve 20. Outer bypass chamber 66 may fluidly connect the plurality of valve sleeve bypass openings 58 and the one or more housing bypass openings 41. In one embodiment, the one or more housing bypass openings 41 may be positioned near an upper end of the outer bypass chamber 66 and the plurality of valve sleeve bypass openings 58 may be positioned near a lower end of the outer bypass chamber 66. Inner bore 60 of valve sleeve 20 includes inner tapered shoulder 67 and inner recess 68 surrounding the plurality of valve sleeve bypass openings 58.

Figure 7:
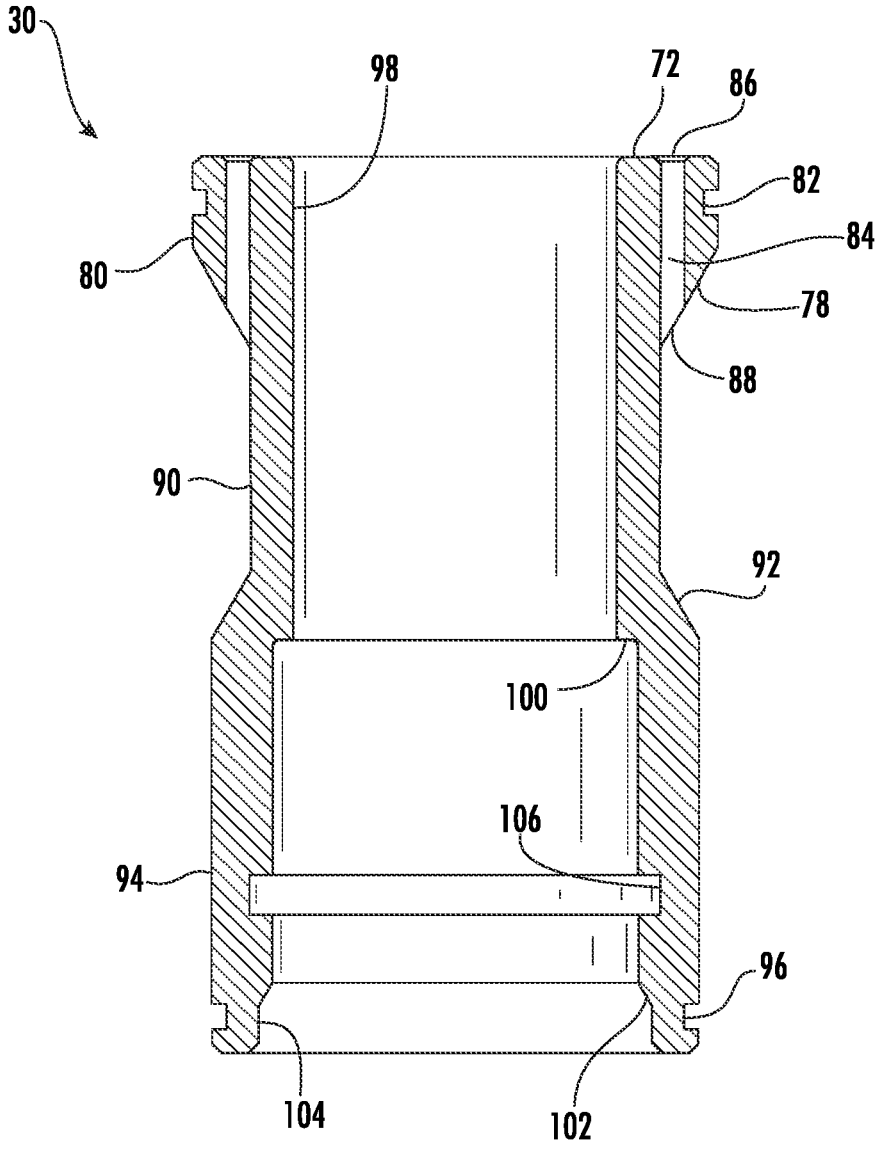
FIG. 7 is a sectional view of the valve.
Figure 8:
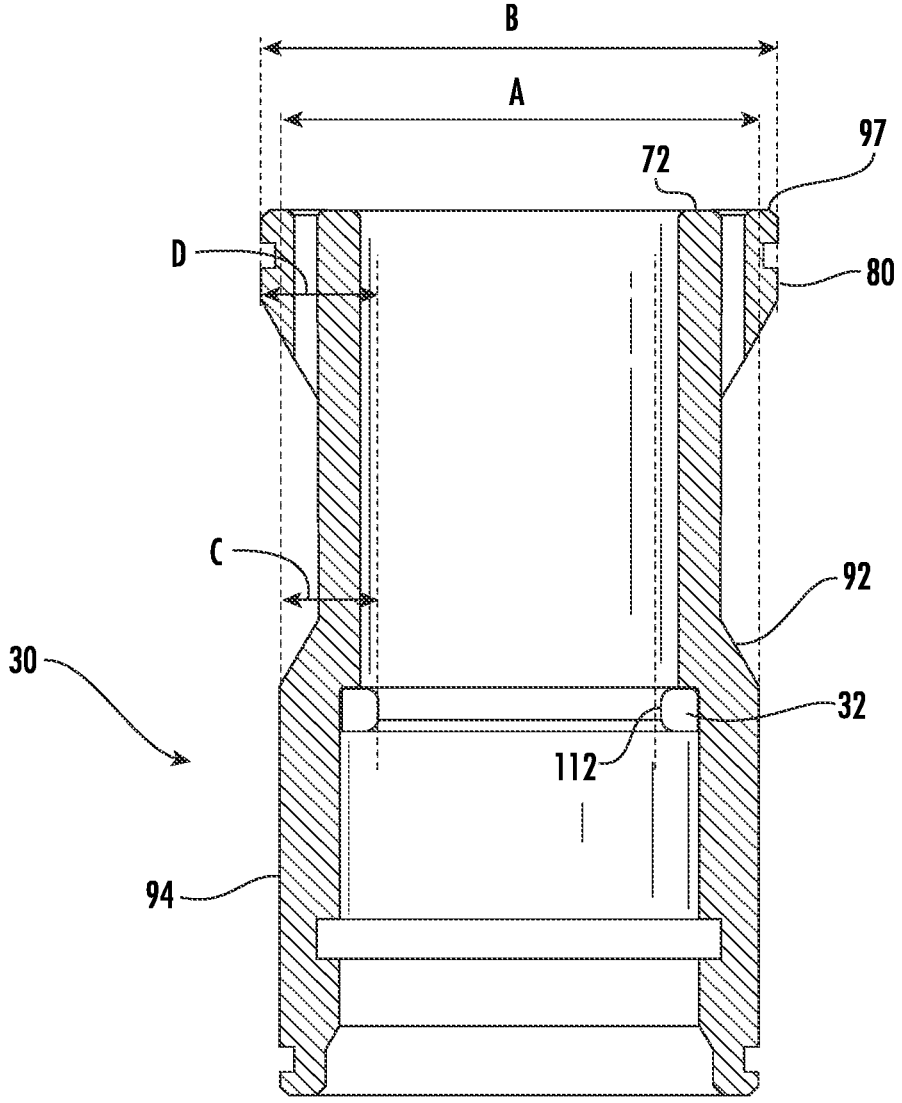
FIG. 8 is a sectional view of the valve and an orifice ring.

With reference now to FIGS. 5-8, valve 30 has a generally tubular shape and extends from upper surface 72 to lower end 74. Valve collar 76 extends from upper surface 72 to lower collar surface 78. In one embodiment, lower collar surface 78 is a tapered surface. Outer collar surface 80 may include recess 82 configured to house an O-ring or other seal mechanism for providing a fluid seal between valve 30 and valve sleeve 20. A plurality of valve bypass bores 84 extend axially through valve collar 76. Each valve bypass bore 84 extends from a bore inlet 86 on upper surface 72 to a bore outlet 88 on lower collar surface 78. Valve 30 may include any number of valve bypass bores 84. For example, valve 30 may include between 1 and 50 valve bypass bores 84. Reduced diameter section 90 extends from lower collar surface 78 to lower valve shoulder 92. Lower outer surface 94 extends from lower valve shoulder 92 to lower end 74 of valve 30. Lower outer surface 94 may include recess 96 configured to house an O-ring or other seal mechanism for providing a fluid seal between valve 30 and valve sleeve 20. Outer collar surface 80 may have an expanded diameter B that is larger than a seal diameter A of lower outer surface 94. Seal diameter A of lower outer surface 94 and expanded diameter B of outer collar surface 80 and upper surface 72 are illustrated in FIG. 8. The portion of upper surface 72 that extends beyond seal diameter A of lower outer surface 94 may be referred to as the peripheral upper surface 97. In one embodiment, peripheral upper surface 97 includes a beveled portion. Valve inner bore 98 extends from upper surface 72 to lower end 74. Valve inner bore 98 includes inner shoulder 100 and tapered surface 102 extending to lower groove 104. Valve inner bore 98 may also include recess 106 configured to house an O-ring or other seal mechanism for providing a fluid seal between valve 30 and spring mandrel 34. Valve bypass bores 84 are disposed between valve inner bore 98 and outer collar surface 80.

With reference to FIGS. 2 and 7-8, valve 30 may be slidingly disposed within inner bore 60 of valve sleeve 20. Upper surface 72 of valve 30 and upper end 42 of valve sleeve 20 may both directly engage a lower surface of upper ring 26 in the closed position. In the closed position, peripheral upper surface 97 may be positioned directly under upper ring 26.

Referring again to FIG. 2, a sliding hydraulic seal may be formed between valve 30 and valve sleeve 20 at interface 108. The sliding hydraulic seal may be formed by a metal to metal interface. Inner bypass chamber 110 between valve 30 and valve sleeve 20 may be defined by inner bore 60 of valve sleeve 20 and reduced diameter section 90 of valve 30. The upper end of inner bypass chamber 110 may be defined by lower collar surface 78, and the lower end of inner bypass chamber 110 may be defined by lower valve shoulder 92. Inner bypass chamber 110 may be in fluid communication with valve bypass bores 84. In the closed position shown in FIG. 2, valve 30 closes housing bypass openings 41 and valve sleeve bypass openings 58 to prevent bypass fluid flow. Accordingly, most of a fluid flowing through an inner bore of upper ring 26 flows through valve inner bore 98. In a partially open position and a fully open position (described below), inner bypass chamber 110 may be in fluid communication with the plurality of valve sleeve bypass openings 58 and the housing bypass openings 41 to form a bypass fluid path from the inside of flow rate control system 10 to the annular space outside of housing 14.

As shown in FIG. 2, orifice ring 32 may be disposed in valve inner bore 98 such that an upper surface of orifice ring 32 engages inner shoulder 100 of valve inner bore 98. Orifice ring 32 includes orifice inner bore 112, which may have a smaller diameter than valve inner bore 98 above orifice ring 32.

Figure 9:
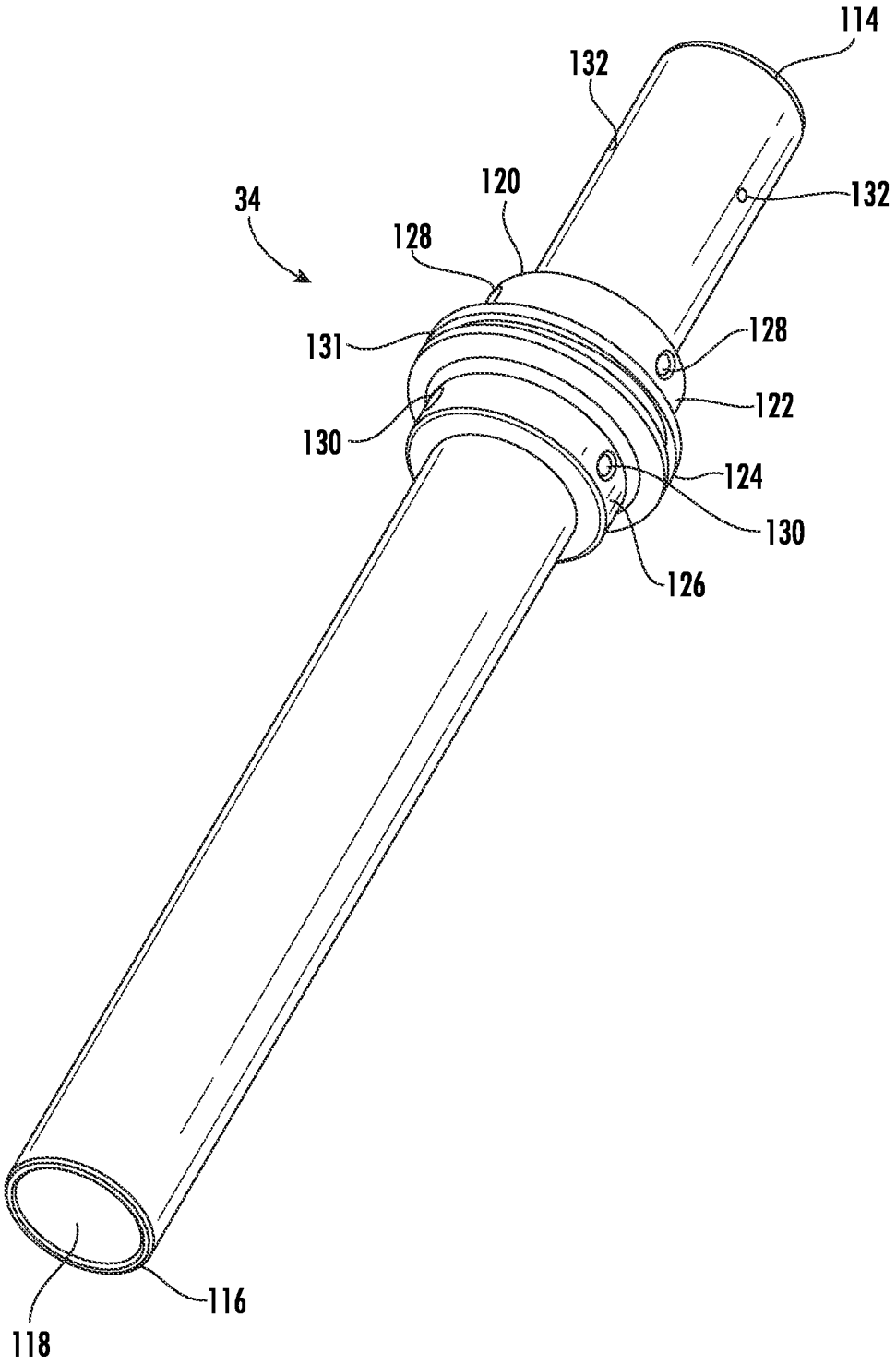
FIG. 9 is an isometric view of a spring mandrel of the flow rate control system.

With reference now to FIG. 9, spring mandrel 34 has a generally tubular shape and extends from upper end 114 to lower end 116. Inner bore 118 of spring mandrel 34 also extends from upper end 114 to lower end 116. Spring mandrel 34 includes seal block 120 having an expanded outer diameter relative to the remainder of spring mandrel 34. Seal block 120 includes upper nozzle surface 122, central outer surface 124, and lower nozzle surface 126. One or more upper nozzles 128 may extend radially from inner bore 118 to upper nozzle surface 122 on seal block 120. One or more lower nozzles 130 may extend radially from inner bore 118 to lower nozzle surface 126 on seal block 120. Spring mandrel 34 may include any number of upper and lower nozzles 128, 130. For example, spring mandrel 34 may include between 1 and 10 upper nozzles 128 and between 1 and 10 lower nozzles 130. Central outer surface 124 has a larger outer diameter than upper and lower nozzle surfaces 122 and 126. Central outer surface 124 may include recess 131 configured to house an O-ring or other seal mechanism for providing a fluid seal between spring mandrel 34 and spring sleeve 24 (as shown in FIG. 2). Spring mandrel 34 may further include one or more ports 132 extending radially from inner bore 118 to an outer surface above seal block 120. Spring mandrel 34 may include any number of ports 132. For example, spring mandrel 34 may include between 1 and 10 ports 132.

Referring again to FIG. 2, upper end 114 of spring mandrel 34 is disposed within valve inner bore 98 such that upper end 114 engages a lower surface of orifice ring 32. The one or more ports 132 of spring mandrel 34 may be aligned with lower groove 104 of valve inner bore 98. Spring mandrel 34 may be disposed through an inner bore of valve stop 22 with seal block 120 disposed below valve stop 22.

Valve stop 22 is disposed within housing inner bore 18 below valve sleeve 20. Valve stop 22 may be formed of a generally tubular ring. The inner bore of valve stop 22 may include recess 136 configured to house an O-ring or other seal mechanism for providing a fluid seal between spring mandrel 34 and valve stop 22. In one embodiment, an upper end of seal block 120 engages a lower end of valve stop 22 in the closed position. Ports 132 and lower groove 104 may provide fluid communication between inner bore 118 of spring mandrel 34 and valve chamber 138. In the closed position, valve chamber 138 may be formed between valve sleeve 20 and spring mandrel 34. The upper end of valve chamber 138 may be formed by lower end 74 of valve 30, and the lower end of valve chamber 138 may be formed by an upper surface of valve stop 22.

With reference again to FIGS. 1 and 2, spring sleeve 24 is disposed within housing inner bore 18 below valve stop 22. Spring sleeve 24 may have a generally tubular shape. Inner bore 142 of spring sleeve 24 may extend from upper end 144 to lower end 146. Inner bore 142 may include spring sleeve shoulder 148 near lower end 146. Spring mandrel 34 may be disposed through inner bore 142 of spring sleeve 24. In all positions, lower end 116 of spring mandrel 34 may extend beyond lower end 146 of spring sleeve 24. Inner bore 142 of spring sleeve 24 may also include recess 150 configured to house an O-ring or other seal mechanism for providing a fluid seal between spring mandrel 34 and spring sleeve 24. Lower end 146 of spring sleeve 24 engages lower housing shoulder 28.

Upper spring ring 40 may be disposed around spring mandrel 34. An upper surface of upper spring ring 40 may directly engage a lower surface of seal block 120 of spring mandrel 34. A lower surface of upper spring ring 40 may directly engage an upper end of spring 36. Upper spring ring 40 may have a generally tubular shape with an inner diameter dimensioned to receive spring mandrel 34. An outer diameter of upper spring ring 40 may be sized to provide annular space 152 between outer surface 154 of upper spring ring 40 and inner bore 142 of spring sleeve 24.

Lower spring ring 38 may also be disposed around spring mandrel 34. An upper surface of lower spring ring 38 may directly engage a lower end of spring 36. A lower surface of lower spring ring 38 may directly engage spring sleeve shoulder 148. Lower spring ring 38 may have a generally tubular shape with an inner diameter dimensioned to received spring mandrel 34. An outer diameter of lower spring ring 38 may be sized to fit within inner bore 142 of spring sleeve 24 above spring sleeve shoulder 148.

Spring 36 applies an upward spring force on valve assembly 19. Specifically, spring 36 applies an upward force on upper spring ring 40, which transmits the upward spring force to seal block 120 of spring mandrel 34. Upper end 114 of spring mandrel 34 transmits the upward spring force to orifice ring 32, which transmits the upward spring force to valve 30 through inner shoulder 100. In other words, the spring force biases upper spring ring 40, spring mandrel 34, orifice ring 32, and valve 30 toward the closed position. The upward movement of valve assembly 19 may be limited by upper surface 72 of valve 30 engaging the lower surface of upper ring 26. The upward movement of valve assembly 19 may also be limited by the upper end of seal block 120 of spring mandrel 34 engaging a lower surface of valve stop 22. Because of this upward spring force, the default position of flow rate control system 10 with no fluid flow is the closed position shown in FIGS. 1 and 2.

Referring still to FIGS. 1 and 2, upper dampening chamber 160 and lower dampening chamber 162 may be formed between spring mandrel 34 and spring sleeve 24. An upper end of upper dampening chamber 160 may be defined by a lower surface of valve stop 22, and a lower end of upper dampening chamber 160 may be defined by central outer surface 124 of seal block 120 of spring mandrel 34. An upper end of lower dampening chamber 162 may be defined by central outer surface 124 of seal block 120, and a lower end of lower dampening chamber 162 may be defined by spring sleeve shoulder 148 of spring sleeve 24. In this way, central outer surface 124 separates upper dampening chamber 160 and lower dampening chamber 162. In other words, central outer surface 124 creates a dampening chamber seal. In one embodiment, upper spring ring 40, spring 36, and lower spring ring 38 are disposed in lower dampening chamber 162.

The one or more upper nozzles 128 provide fluid communication between inner bore 118 of spring mandrel 34 and upper dampening chamber 160. The one or more lower nozzles 130 provide fluid communication between inner bore 118 of spring mandrel 34 and lower dampening chamber 162. When a fluid begins to flow through inner bore 118 of spring mandrel 34, a small portion of the fluid may flow through nozzles 128, 130 to fill upper and lower dampening chambers 160, 162, respectively. Upper and lower nozzles 128 and 130 may be configured to provide a volumetric fluid flow rate between inner bore 118 of spring mandrel 34 and upper and lower dampening chambers 160, 162. As valve assembly 19 moves up or down, the volumes of upper and lower dampening chambers 160 and 162 change. The rate at which the fluid moves in and out of the upper and lower dampening chambers 160 and 162 controls the rate at which valve assembly 19 moves between open and closed positions. In one embodiment, upper and lower nozzles 128 and 130 each include a reduced diameter portion to restrict fluid flow dependent on the sum of the forces acting on valve assembly 19 from spring 36 and the pressure differential created by fluid flow across valve assembly 19.

Figure 10:
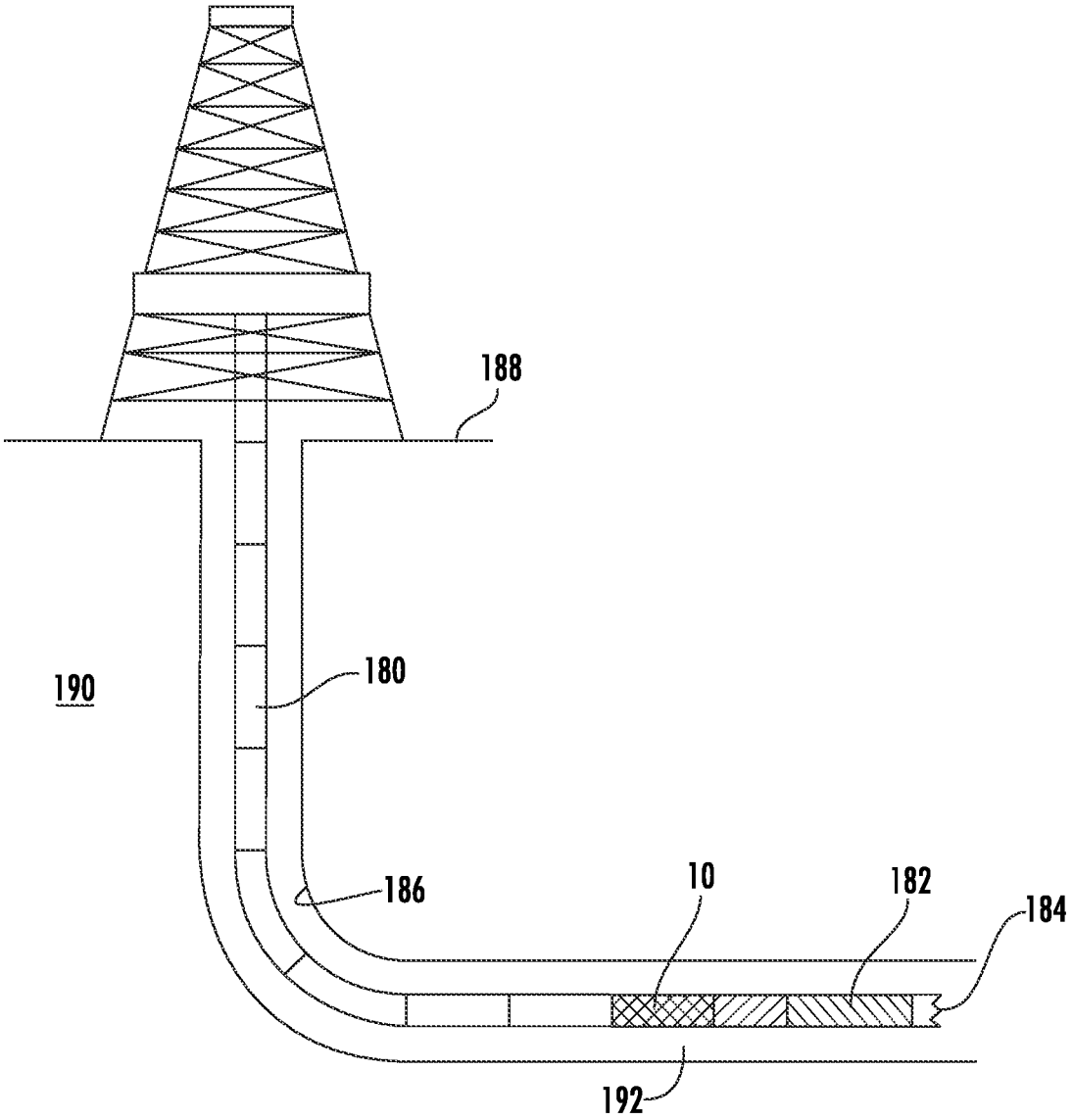
FIG. 10 is a schematic view of a flow rate control system in a tubular string disposed within a wellbore.

With reference to FIG. 10, flow rate control system 10 may be secured below tubular string 180. A bottom hole assembly, including drilling motor 182 and drill bit 184, may be secured below flow rate control system 10. Tubular string 180, flow rate control system 10, and the components secured below may be lowered into wellbore 186 extending below surface 188 through subterranean formation 190. With the flow rate control system 10 in the closed position shown in FIGS. 1 and 2, substantially all of a fluid flowing through the tubular string flows through flow rate control system 10 to drilling motor 182. Specifically, the fluid may flow through an inner bore of the upper sub 12, an inner bore of upper ring 26, valve inner bore 98, orifice inner bore 112, inner bore 118 of spring mandrel 34, housing inner bore 18 below spring mandrel 34, and an inner bore of lower sub 16. A negligible amount of the fluid may leak through the seal arrangement in flow rate control system 10. The fluid flow through drilling motor 182 may rotate drill bit 184 to further drill wellbore 186. Drill bit 184 breaks up the subterranean formation 190 into drill cuttings. The fluid flowing through drilling motor 182 and drill bit 184 carry the drill cuttings to surface 188 through wellbore annulus 192.

Referring again to FIGS. 1, 2, and 8, the fluid flowing through flow rate control system 10 in the closed position applies a downward force on a first active valve area C of valve assembly 19. The first active valve area C is defined by the cross sectional area of valve assembly 19 that lies between lower outer surface 94 and inner bore 112 of orifice ring 32. The first active valve area C is illustrated in FIG. 8 and includes a portion of upper surface 72 of valve 30, lower valve shoulder 92 of valve 30, and a portion of the upper surface of orifice ring 32 that are disposed between lower outer surface 94 and inner bore 112 of orifice ring 32. This area is equal to the cross sectional area of valve assembly 19 minus the cross sectional area of peripheral upper surface 97. A portion of the fluid flows through valve bypass bores 84 to fill inner bypass chamber 110, which is closed. In the closed position, the pressure inside upper ring 26 (i.e., the pressure above valve collar 76) is approximately equal to the pressure in inner bypass chamber 110 (i.e., the pressure below valve collar 76). For this reason, the flow rate control system 10 is flow rate controlled in the closed position. "Flow rate controlled" means that changes in a flow rate of a fluid flowing through flow rate control system 10 cause a pressure differential across valve assembly 19 that creates a downward force acting on the first active valve area C of valve assembly 19 to slide from a closed position to a partially open position. A portion of the fluid may also flow through ports 132 of spring mandrel 34 and through lower groove 104 of valve 30 to prevent hydro locking and allow fluid in valve chamber 138 to vent to inner bore 118. A portion of the fluid may also flow through upper nozzles 128 and lower nozzles 130 to fill or empty upper dampening chamber 160 and lower dampening chamber 162, respectively.

Referring again to FIGS. 1 and 2, an increase in the flow rate of the fluid flowing through flow rate control system 10 in the closed position applies an increased downward force on the first active valve area C of valve assembly 19. When the downward force reaches a predetermined threshold force value that overcomes the upward spring force on the valve assembly 19, the downward force causes valve assembly 19 to slide in a downward direction within sleeve assembly 17 and housing 14 and to compress spring 36. Specifically, valve 30 slides downward within valve sleeve 20, and spring mandrel 34 slides downward within valve sleeve 20 and spring sleeve 24.

In order for spring mandrel 34 to slide downward, a portion of the fluid in lower dampening chamber 162 must be returned to inner bore 118 of spring mandrel 34 through lower nozzles 130 and more fluid must enter upper dampening chamber 160 through upper nozzles 128. The restricted diameter of nozzles 128 and 130 delay the movement of valve assembly 19 in response to a change in the fluid flow rate. In this way, the dampening chambers provide a dampening effect on the movement of valve assembly 19. Valve assembly 19 slides in response to average fluid flow rates over time as opposed to changes of short duration or quicker fluctuations. Fluid in valve chamber 138 must also return to inner bore 118 of spring mandrel 34 as valve 30 and spring mandrel 34 slide downward.

Figure 11:
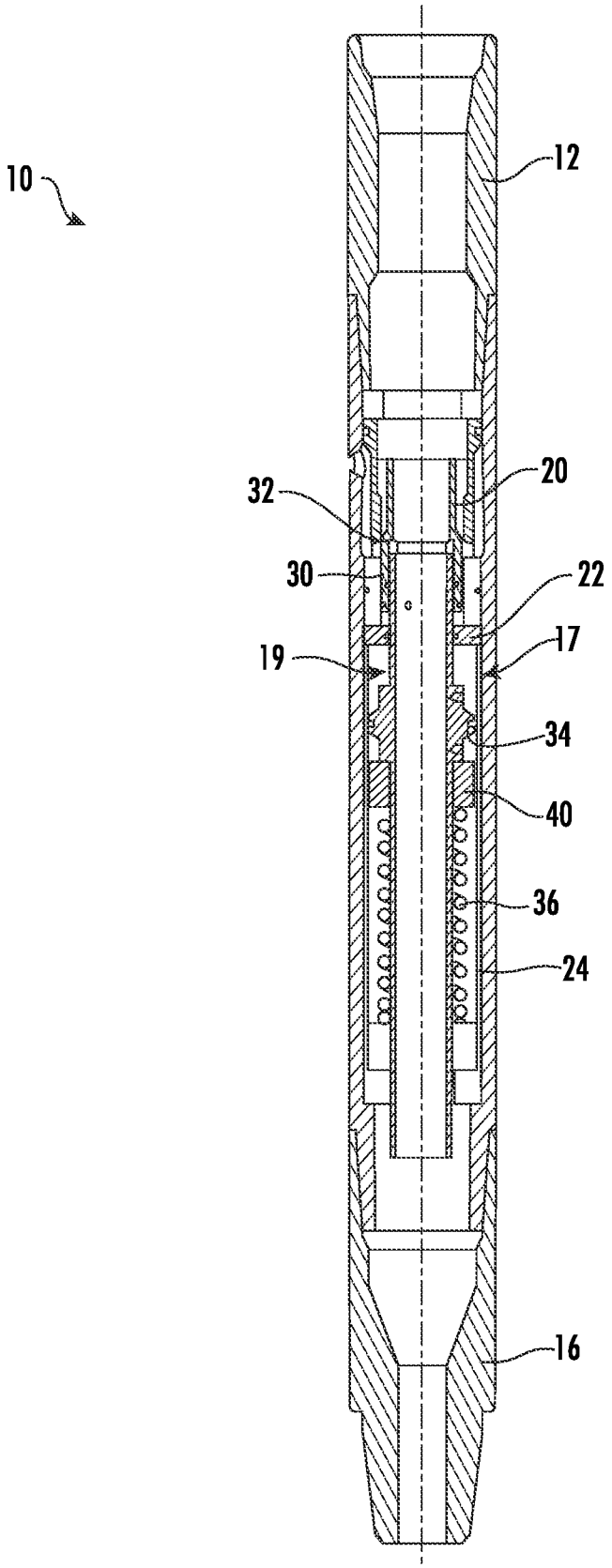
FIG. 11 is a sectional view of the flow rate control system in a partially open position.
Figure 12:
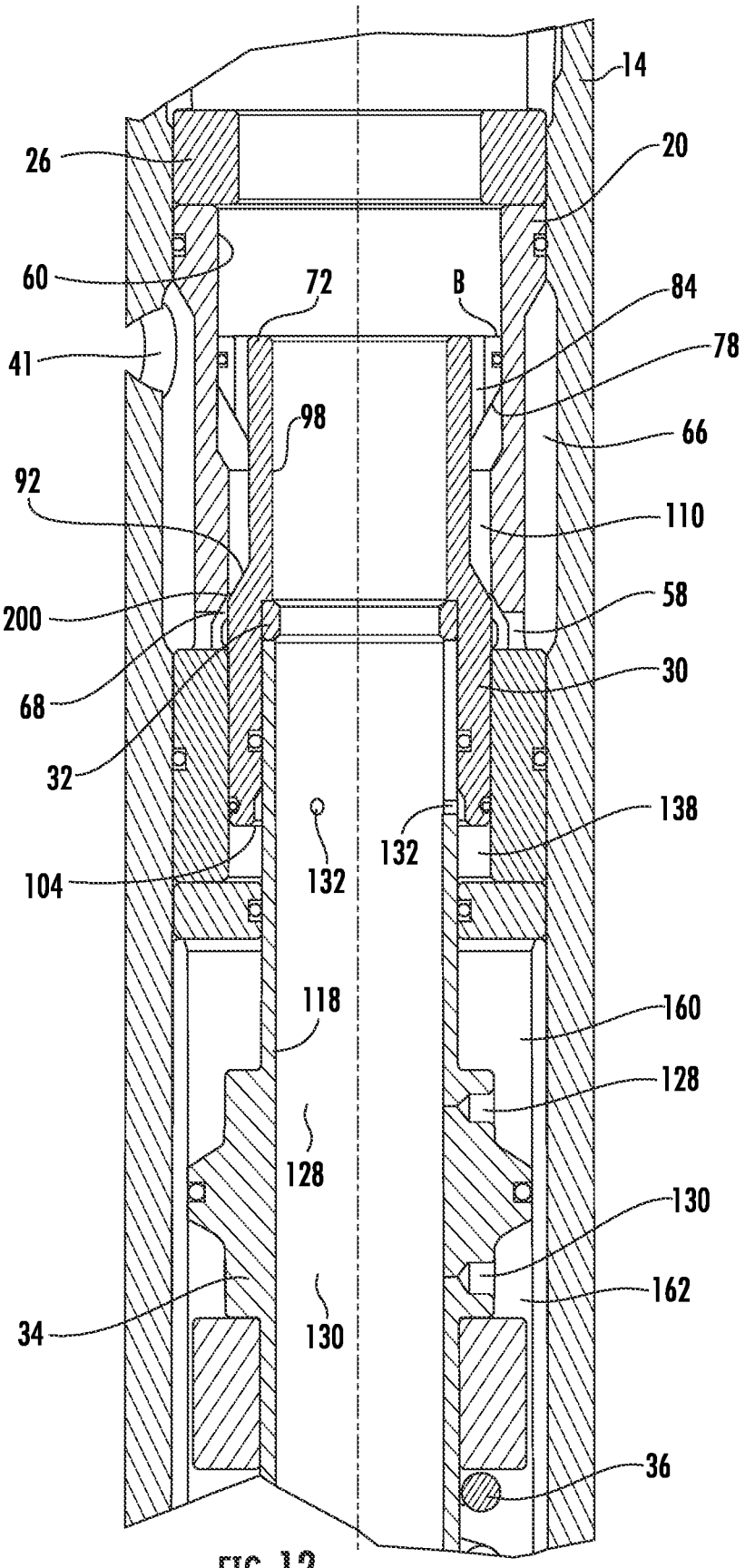
FIG. 12 is a detail sectional view of a portion of the flow rate control system in the partially open position.

Valve assembly 19 slides downward in response to increasing fluid flow rates until reaching a partially open position illustrated in FIGS. 11 and 12. In this position, a lower portion of lower valve shoulder 92 is aligned with inner recess 68 of valve sleeve 20 such that gap 200 opens to form a bypass fluid path. The bypass fluid path fluidly connects the inner bores of the flow rate control system 10 to annulus 192 (shown in FIG. 10) surrounding housing 14. The bypass fluid path includes valve bypass bores 84, inner bypass chamber 110, the plurality of valve sleeve bypass openings 58, outer bypass chamber 66, and the one or more housing bypass openings 41.

With flow rate control system 10 in the partially open position, a portion of the fluid flowing through upper ring 26 is diverted through the bypass fluid path and into annulus 192. The diverted fluid may assist in clearing cuttings from wellbore annulus 192. Additionally, the diverted fluid flow may reduce the flow rate of fluid flowing to drilling motor 182, thereby preventing damage to drilling motor 182 that may be caused by higher flow rates.

In the partially open position, a bypass fluid path is created that may include bypass bores 84, inner bypass chamber 110, bypass openings 58, outer bypass chamber 66, and housing bypass openings 41. As fluid is forced through the bypass fluid path by the pressure differential between the inner bore of flow rate control system 10 and the annular area 192 (shown in FIG. 10), a second active valve area D is created by the pressure differential across bypass bores 84. The second active valve area D (shown in FIG. 8) may include peripheral upper surface 79 (i.e., the portion of upper surface 72 of valve 30 that is outside of seal diameter A and within expanded diameter B). More specifically, second active valve area D is defined as the cross sectional area of valve assembly 19 that is inside of expanded diameter B minus first active valve area C. In the partially open position, the second active valve area D may act as a downward biased piston, which moves in response to the pressure differential between the inner bore of flow rate control system 10 and the annular area 192. The flow rate through valve inner bore 98 decreases when gap 200 opens because a portion of the fluid flows through the bypass fluid path to annulus 192. Because the second active valve area D is pressure biased downward, when the flow rate through valve inner bore 98 decreases, the total downward force acting on valve 30 against the upward spring force may be equal to or greater than the previous downward force applied from the flow rate alone. For this reason, valve assembly 19 does not move upward to the closed position when the bypass fluid path is opened even though the fluid flow rate and resulting pressure differential through valve inner bore 98 drops.

The pressure in annulus 192 is lower than the pressure within the inner bore of flow rate control system 10 due to the pressure drop across the bottom hole assembly, including drilling motor 182 and drill bit 184. In the partially open position, the pressure inside the portion of inner bore 60 of valve sleeve 20 that is above surface 72 of valve sleeve 30 is greater than the pressure in inner bypass chamber 110 (i.e., the pressure below valve collar 76), which is fluidly connected to annulus 192. For this reason, flow rate control system 10 is pressure controlled in the partially open position. "Pressure controlled" means that changes, up or down, in a pressure differential between a pressure of fluid in the inner bore of flow rate control system and a pressure in an annulus surrounding flow rate control system cause the valve assembly 19 to slide from the partially open position to a fully open position or to the closed position, respectively (and to slide from the fully open position to the partially open position, as described below). In other words, when partially open or fully open, flow rate control system 10 is controlled by the pressure differential between the pressure in the inner bores of flow rate control system 10 and the pressure in annulus 192. If fluid flow slows or temporarily stops while the pressure differential across flow rate control system 10 and annulus 192 remains, valve assembly 19 will not return to the closed position even with the reduction or temporary elimination of fluid flow. When fluid flow is stopped for a longer time, internal fluid pressure may bleed off through the bypass fluid path until the force acting on second active valve area D is less than the upward force from spring 36 causing the valve to close.

With flow rate control system 10 in the partially open position, the pressure differential between the inner bore of upper ring 26 and annulus 192 acts on the second active valve area D to slide valve assembly 19 further in the downward direction. As valve assembly 19 slides further downward, more of the fluid in lower dampening chamber 162 is returned to inner bore 118 of spring mandrel 34 through lower nozzles 130 and more fluid enters upper dampening chamber 160 through upper nozzles 128. The restricted diameter of nozzles 128 and 130 delay the movement of valve assembly 19 in response to changes in the pressure differential. Dampening chambers 160, 162 provide a dampening effect to cause valve assembly 19 to slide in response to average pressure values over time as opposed to changes of short duration or quicker fluctuations. More fluid in valve chamber 138 must also return to inner bore 118 of spring mandrel 34 as valve 30 and spring mandrel 34 slide further downward from the partially open position.

Figure 13:
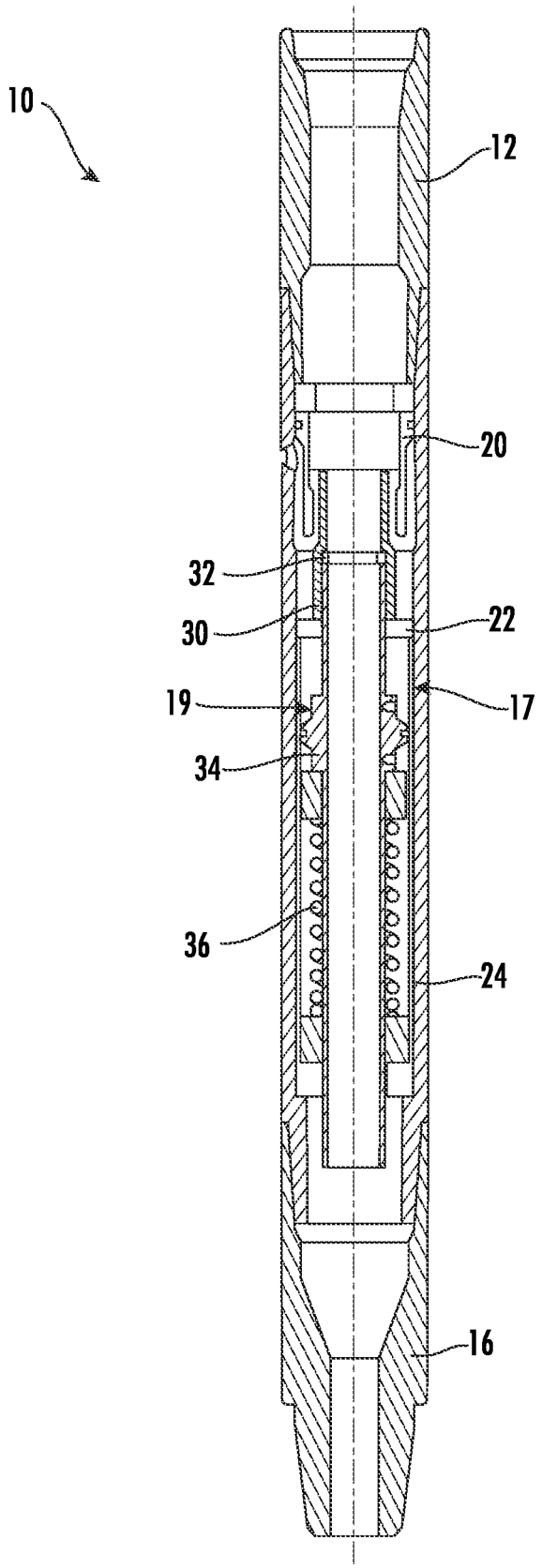
FIG. 13 is a sectional view of the flow rate control system in a fully open position.
Figure 14:
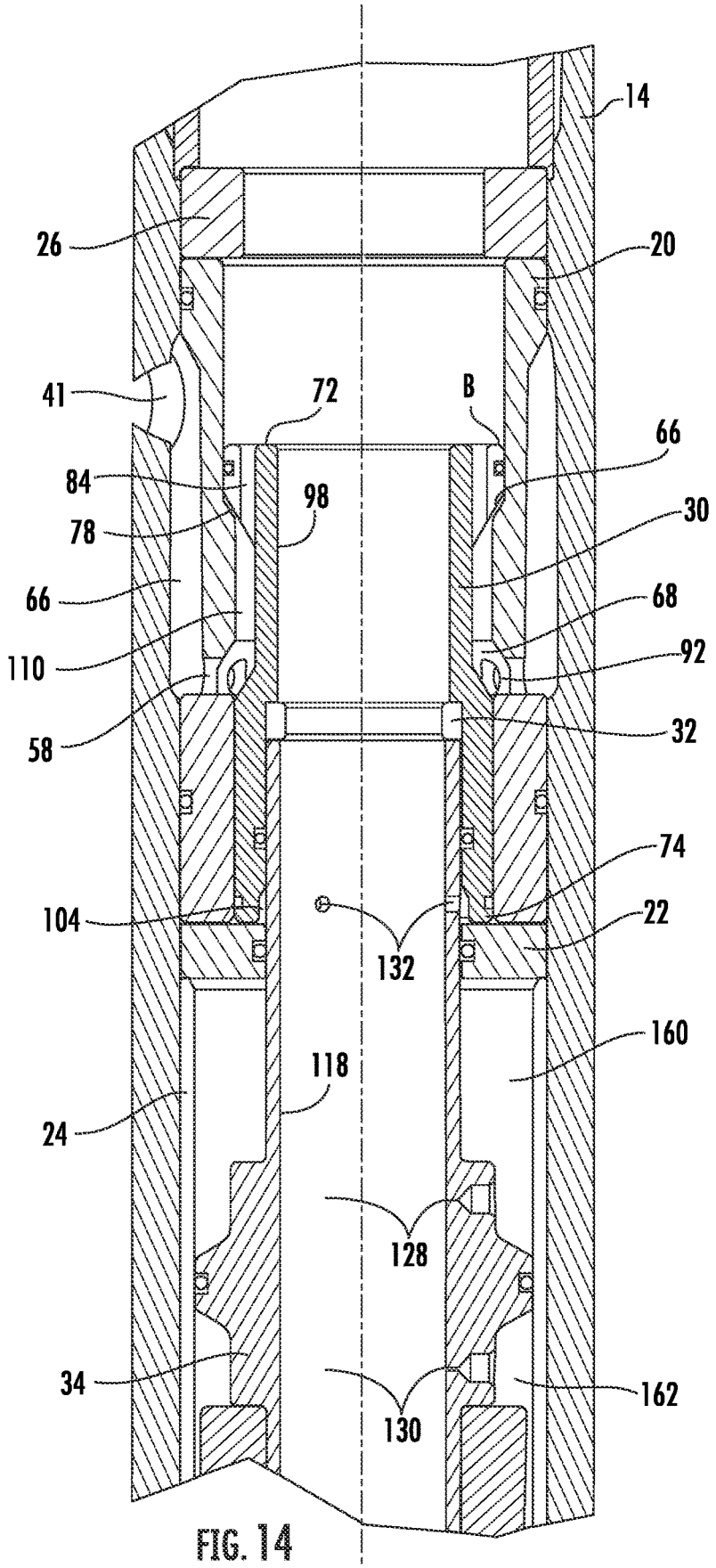
FIG. 14 is a detail sectional view of a portion of the flow rate control system in the fully open position.

Increasing pressure differentials between the inner bore of upper ring 26 and annulus 192 cause valve assembly 19 to continue to slide downward until reaching a fully open position illustrated in FIGS. 13 and 14. In this position, lower end 74 of valve 30 engages valve stop 22. The lower portion of lower valve shoulder 92 is disposed below inner recess 68 of valve sleeve 20 to fully open the bypass fluid path from valve bypass bores 84 and inner bypass chamber 110 to the plurality of valve sleeve bypass openings 58, outer bypass chamber 66, and the one or more housing bypass openings 41. In the fully open position, a maximum rate of bypass flow may be achieved by flow rate control system 10. A larger portion of the fluid flowing through upper ring 26 is diverted through the bypass fluid path and into annulus 192.

Flow rate control system 10 is pressure controlled in the fully open position. If fluid flow slows or temporarily stops (e.g., due to a plugged drill bit or a stalled motor) while the pressure differential between flow rate control system 10 and annulus 192 remains, valve assembly 19 will not slide upward towards the closed position. In order to cause valve assembly 19 to slide upward and return to the closed position shown in FIGS. 1 and 2, the pressure difference between the inner bore of flow rate control system 10 and annulus 192 must be reduced. This may be accomplished by reducing the pressure in the inner bore of upper ring 26, by increasing the pressure in annulus 192, or by turning off the fluid pump and allowing the pressure to equalize across the bypass fluid path. Flow rate control system 10 reaches the partially open position at a predefined reduction in the pressure difference. Once valve assembly 19 slides upward past the partially open position, the second active valve area D becomes inactive, reverting flow rate control system 10 back to a flow controlled valve. Without sufficient flow rate, valve assembly 19 continues to move to the closed position shown in FIGS. 1 and 2.

Because flow rate control system 10 is flow rate controlled in the closed position, it is automatically activated when a fluid flow rate exceeds a maximum allowed for drilling motor 182. Flow rate control system 10 is pressure controlled in the partially open position and the fully open position. Accordingly, after beginning to divert a portion of the fluid flow to annulus 192, flow rate control system 10 is not unintentionally closed by flow rate changes. Flow rate control system 10 is transferred to the closed position only in response to a predefined pressure change created at surface 188. Additionally, the dampening effect provided by the arrangement of nozzles 128, 130 and dampening chambers 160, 162 prevents flow rate control system 10 from being unintentionally opened or closed due to pressure pulses, vibration, bit plugging, or motor stalling. In one embodiment, the dampening effect may effectively require a flow rate change or pressure change to be maintained for 30-45 seconds before the flow rate control system 10 changes positions (i.e., between the closed position and the partially open position, or between the partially open position and the fully open position).

Flow rate control system 10 is configured to reach the partially open position (in FIGS. 11 and 12) at a predefined flow rate and to reach the fully open position (in FIGS. 13 and 14) at a predefined pressure differential. In this way, flow rate control system 10 maintains a flow rate to drilling motor 182 that is lower than a maximum desired flow rate. In a further embodiment, the predefined flow rate and predefined pressure differential may be adjusted, such as by replacing orifice ring 32 with an orifice ring having a different inner diameter or by replacing spring 36 with a spring having a different compression strength. Additionally, the amount of fluid that flows through the bypass fluid path in the partially open position and in the fully open position may be adjusted by adjusting a ratio of the total cross-sectional area of valve bypass bores 84 to the total cross-sectional area of upper surface 72 of valve 30.

In an alternate embodiment, upper and lower dampening chambers 160, 162 may be prefilled with a fluid, such as an oil or drilling fluid.

In another alternate embodiment, upper and lower nozzles 128, 130 may be replaced by one or more nozzles extending axially through seal block 120 to fluidly connect upper and lower dampening chambers 160, 162. In this embodiment, fluid flows directly from lower dampening chamber 162, through the nozzles, and into upper dampening chamber 160 as valve assembly 19 travels in the downward direction. Conversely, fluid flows directly from upper dampening chamber 160, through the nozzles, and into lower dampening chamber 162 as valve assembly 19 travels in the upward direction. The nozzles and dampening chambers provide a dampening effect to slow the movement of valve assembly 19 between the closed position, the partially open position, and the fully open position.

In another alternate embodiment, flow rate control system 10 may include only one dampening chamber. In this embodiment, a seal may be eliminated to allow fluid flow into a space on the opposite side of seal block 120.

In another alternate embodiment, the valve bypass bores 84 may extend radially from inner bore 98 of valve 30 through to lower collar surface 78, reduced diameter section 90, or lower valve shoulder 92 of valve 30.

In yet another alternate embodiment, one or more parts of the valve assembly may be integrally formed or may be split into separate parts. In one example, the orifice ring and the spring mandrel may be integrally formed of a single piece. In another example, the valve, the orifice ring, and the spring mandrel may be integrally formed of a single piece. In another example, the spring mandrel may be formed of two or more separate pieces that are secured together. In another example, the valve may be formed of two or more separate pieces that are secured together. Additionally, one or more parts of the sleeve assembly may be integrally formed or may be split into separate parts. In one example, the valve stop and the spring sleeve may be integrally formed of a single piece. In another example, the valve sleeve, the valve stop, and the spring sleeve may be integrally formed of a single piece. In another example, the spring sleeve may be formed of two or more separate pieces that are secured together. In another example, the valve sleeve may be formed of two or more separate pieces that are secured together.

In a further alternate embodiment, the flow rate control system may include a valve assembly without a sleeve assembly such that valve assembly slides directly within a housing inner bore.

In a further alternate embodiment, the flow rate control system may include a valve assembly that completely closes the flow of the drilling fluid through the mud motor below, thereby bypassing all drilling fluid to the annulus outside of the housing of the flow rate control system. In this complete bypass position, the drilling fluid can be changed to different fluids, such as LCM fluid, perforating fluid, or fracking fluid.

Flow rate control system 10 prevents drilling motor 182 from being exposed to a fluid flow rate that is higher than a maximum allowable flow rate by providing a bypass flow through the bypass fluid path when the flow rate in flow rate control system 10 exceeds the maximum allowable flow rate. For example, but not by way of limitation, if a drilling motor is rated for a maximum drilling fluid flow rate of 600 GPM, flow rate control system 10 may divert 300 GPM through the bypass fluid path when the drilling fluid flow rate in flow rate control system 10 reaches 900 GPM. In an alternate example, but not by way of limitation, if the maximum design flow rate of a drilling motor is 600 GPM, flow rate control system 10 may divert 100 GPM through the bypass fluid path when the drilling fluid flow rate in flow rate control system 10 reaches 700 GPM.

Except as otherwise described or illustrated, each of the components in this device has a generally cylindrical shape and may be formed of steel, another metal, or any other durable material. Portions of flow rate control system 10 may be formed of a wear resistant material, such as tungsten carbide or ceramic coated steel. In one embodiment, the portions of valve 30 and valve sleeve 20 at interface 108 (shown in FIG. 2) may be formed of a wear resistant material.

Each device described in this disclosure may include any combination of the described components, features, and/or functions of each of the individual device embodiments. Each method described in this disclosure may include any combination of the described steps in any order, including the absence of certain described steps and combinations of steps used in separate embodiments. Any range of numeric values disclosed herein includes any subrange therein. "Plurality" means two or more. "Above" and "below" shall each be construed to mean upstream and downstream, such that the directional orientation of the device is not limited to a vertical arrangement.

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

We claim:

1. A flow rate control system comprising:

a housing including one or more housing bypass openings extending radially from a housing inner bore to an outer surface of the housing;

a valve assembly slidingly disposed within the housing inner bore, the valve assembly including a valve and an orifice; wherein the valve includes a valve collar defining an upper surface of the valve and defining an outer collar surface and a lower collar surface, a lower valve shoulder, a reduced diameter outer surface extending from the lower collar surface to the lower valve shoulder, a valve inner bore extending axially from the upper surface to a lower end, and a plurality of valve bypass bores extending axially through the valve collar between the valve inner bore and the outer collar surface; wherein the orifice is disposed in the valve inner bore; and wherein the valve assembly is configured to slide between a closed position and a fully open position;

a spring disposed within the housing inner bore and around a portion of the valve assembly, wherein the spring biases the valve assembly toward the closed position;

wherein in the closed position the valve closes the housing bypass openings, and wherein in the closed position the valve assembly is flow rate controlled;

wherein in a partially open position and the fully open position a bypass fluid path is formed by the valve bypass bores and the housing bypass openings; and wherein in the partially open position and the fully open position the valve assembly is pressure controlled.

2. The flow control system of claim 1, wherein each of the valve bypass bores extends from an inlet on the upper surface of the valve to an outlet on the lower collar surface.

3. The flow control system of claim 1, wherein the orifice is formed by an orifice ring disposed in the valve inner bore.

4. The flow control system of claim 1, further comprising a sleeve assembly stationarily secured within the housing inner bore; wherein the valve assembly is slidingly disposed through the sleeve assembly; wherein the sleeve assembly includes a valve sleeve disposed around the valve, the valve sleeve including a reduced diameter section and a plurality of valve sleeve bypass openings extending radially from an inner bore to an outer surface of the reduced diameter section, wherein the bypass fluid path in the fully open position further includes the valve sleeve bypass openings.

5. The flow control system of claim 4, further comprising one or more dampening chambers formed between the valve assembly and the sleeve assembly, wherein one or more dampening nozzles fluidly connects an inner bore of the valve assembly to the one or more dampening chambers to slow the sliding movement of the valve assembly in the sleeve assembly.

6. The flow control system of claim 4, wherein a metal to metal seal is formed between the valve sleeve and the valve.

7. The flow control system of claim 4, wherein the bypass fluid path in the partially open position and the fully open position further includes an inner bypass chamber defined between the valve sleeve and the reduced diameter outer surface of the valve, wherein in the partially open position and the fully open position the inner bypass chamber fluidly connects the valve bypass bores and the valve sleeve bypass openings.

8. The flow control system of claim 7, wherein the bypass fluid path in the partially open position and the fully open position further includes an outer bypass chamber defined between the housing and the reduced diameter section of the valve sleeve, wherein in all positions the outer bypass chamber fluidly connects the valve sleeve bypass openings and the housing bypass openings.

9. The flow control system of claim 8, wherein the valve assembly further includes a spring mandrel disposed below the valve and the orifice, the spring mandrel including an inner bore and an upper end engaging the valve inner bore, wherein the spring is disposed around an outer surface of the spring mandrel, and wherein the spring biases the spring mandrel toward the closed position to bias the valve toward the closed position.

10. The flow rate control system of claim 9, wherein the spring mandrel includes a seal block with an outer surface having an expanded diameter, wherein the spring biases the seal block toward the closed position.

11. The flow rate control system of claim 10, further comprising a spring sleeve disposed within the housing inner bore and around the spring mandrel and the spring.

12. The flow rate control system of claim 11, wherein the seal block defines an upper dampening chamber and a lower dampening chamber between the spring mandrel and the spring sleeve, the seal block including at least one upper nozzle fluidly connecting the inner bore of the spring mandrel to the upper dampening chamber and at least one lower nozzle fluidly connecting the inner bore of the spring mandrel to the lower dampening chamber.

13. The flow rate control system of claim 12, further comprising an upper spring ring and a lower spring ring each disposed around the outer surface of the spring mandrel, wherein the upper spring ring is disposed between the seal block of the spring mandrel and an upper end of the spring, wherein the lower spring ring is disposed between a lower end of the spring and a lower shoulder of the spring sleeve.

14. The flow rate control system of claim 13, wherein the upper spring ring and the spring are disposed in the lower dampening chamber, wherein an annular space is formed between the upper spring ring and the spring sleeve.

15. A method of controlling the flow rate of a fluid flowing to a drilling motor, comprising the steps of:

a) providing a flow rate control system comprising: a housing including one or more housing bypass openings extending radially from a housing inner bore to an outer surface of the housing; a valve assembly slidingly disposed within the housing inner bore, the valve assembly including a valve and an orifice; wherein the valve includes a valve collar defining an upper surface of the valve and defining an outer collar surface and a lower collar surface, a lower valve shoulder, a reduced diameter outer surface extending from the lower collar surface to the lower valve shoulder, a valve inner bore extending axially from the upper surface to a lower end, and a plurality of valve bypass bores extending axially through the valve collar between the valve inner bore and the outer collar surface; wherein the orifice is disposed in the valve inner bore; and wherein the valve assembly is configured to slide between a closed position and a fully open position; a spring disposed within the housing inner bore and around a portion of the valve assembly, wherein the spring biases the valve assembly toward the closed position; wherein in the closed position the valve closes the housing bypass openings, and wherein in the closed position the valve assembly is flow rate controlled; wherein in a partially open position and the fully open position a bypass fluid path is formed by the valve bypass bores and the housing bypass openings; and wherein in the partially open position and the fully open position the valve assembly is pressure controlled;

b) attaching the flow rate control system in a tubular string above a drilling motor;

c) pumping a fluid through the flow rate control system with the valve assembly in the closed position to cause substantially all of the fluid to flow through the valve inner bore to the drilling motor;

d) increasing the flow rate of the fluid above a threshold flow rate value to slide the valve assembly in a downward direction into the partially open position in which a portion of the fluid flows through the bypass fluid path into an annulus surrounding the housing.

16. The method of claim 15, further comprising the step of:

e) with the flow rate control system in the partially open position, decreasing the flow rate of the fluid through the flow rate control system below the threshold flow rate value without sliding the valve assembly into the closed position.

17. The method of claim 15, further comprising the step of:

e) maintaining or increasing the pressure differential between the fluid flowing into the flow rate control system and a fluid in the annulus, to slide the valve assembly further in the downward direction into the fully open position to increase the portion of the fluid flowing through the bypass fluid path into the annulus.

18. The method of claim 17, further comprising the step of:

f) decreasing the pressure differential between the fluid flowing into the flow rate control system and the fluid in the annulus, to slide the valve assembly in an upward direction into the partially open position to decrease the volume of the portion of the fluid flowing through the bypass fluid path into the annulus.

19. The method of claim 18, further comprising the step of:

g) further decreasing the pressure differential between the fluid flowing into the flow rate control system and the fluid in the annulus, to slide the valve assembly further in the upward direction into the closed position.

20. The method of claim 15, wherein the flow rate control system further comprises a sleeve assembly stationarily secured within the housing inner bore, with the valve assembly slidingly disposed through the sleeve assembly, wherein the flow rate control system further comprises one or more dampening chambers formed between the valve assembly and the sleeve assembly, wherein the one or more dampening chambers are fluidly connected to an inner bore of the valve assembly through one or more nozzles; and wherein in step (d) the one or more dampening chambers slow the sliding movement of the valve assembly.

21. The method of claim 15, further comprising the step of:

e) placing the flow rate control system in a complete bypass position in which all fluid flowing into the flow rate control system is diverted through the bypass fluid path into the annulus surrounding the housing above a drilling motor.

22. The method of claim 21, wherein the fluid flowing into the flow rate control system in the complete bypass position is a LCM enriched drilling fluid, a perforating fluid, or a fracking fluid.

* * * * *